United States Patent [19]

Schiron et al.

[11] 4,166,295

[45] Sep. 4, 1979

[54] SWIMMING BATH WITH BATH DIVIDERS

[76] Inventors: Klaus Schiron, Nelkenstrasse 2, 3100 Celle; Hans F. Rupprath, Am goldenen Acker 35, 3001 Bennigsen, both of Fed. Rep. of Germany

[21] Appl. No.: 717,454

[22] Filed: Aug. 24, 1976

[51] Int. Cl.[2] ..... E04H 3/16; E04H 3/18

[52] U.S. Cl. ..... 4/172; 4/172.11; 4/172.19

[58] Field of Search ..... 4/172, 172.11, 172.12, 4/183, 172.13, 172.14, 1, 172.19; 178/748

[56] References Cited

U.S. PATENT DOCUMENTS

| | | | |
|---|---|---|---|
| 3,460,166 | 8/1969 | Weber | 4/172 |
| 3,564,622 | 2/1971 | Meulekamp | 4/172.13 |
| 3,582,999 | 6/1971 | Baker | 4/172.11 |
| 3,659,295 | 5/1972 | Linecker | 4/172.19 |
| 3,659,701 | 5/1972 | Taccone | 178/748.X |
| 3,935,599 | 2/1976 | Stark | 4/172 |
| 3,962,735 | 6/1976 | Davidson | 4/172.12 |

FOREIGN PATENT DOCUMENTS 450364 9/1927 Fed. Rep. of Germany .

OTHER PUBLICATIONS

Cf. Periodical, "Sport-und Bäderbauten", (Sport and Bath Constructions), 7th volume, 1967, pp. 252–258.

*Primary Examiner*—Stuart S. Levy
*Attorney, Agent, or Firm*—Thomas E. Beall, Jr.

[57] ABSTRACT

A swimming bath, preferably a deck-level system bath, which has a freely accessible bath surround, one or more guide rails, and a vertical bath divider, which can be moved on the rails by means of jack wheels or track rollers, is driven by mechanical means over at least half the length of the bath, constructed as a concrete or reinforced concrete wall extending from the upper edge of the swimming bath to the bottom thereof.

7 Claims, 4 Drawing Figures

SWIMMING BATH WITH BATH DIVIDERS

BACKGROUND OF THE INVENTION

1. Field of invention

The invention relates to a swimming bath having one or more guide rails, and a vertical bath divider running on these rails by means of jackwheels or track rollers and driven by mechanical means over at least half of the length of the bath.

2. Description of prior art

A swimming bath is already known (cf. German Pat. No. 450 364) in which a bridging platform can be moved from a head recess over rails mounted on the edge of the bath by means of lines or ropes gripping it from a mechanically or manually operated winch. This bridge platform does not extend as far as the bottom of the bath so that it is possible to swim under it and there is a danger of accidents occurring. Also this bridging platform is made of steel and is therefore liable to corrosion as well as being expensive to manufacture.

A starting and turning platform for swimming baths is also known (cf. periodical "Sport- und Baderbauten" ("Sport and Bath Constructions") 7th volume 1967, pp. 252–258) which is constructed like a pontoon and provided with wheels which rest on tracks in the overflow channels which form the lateral overflow edge of the bath and are driven by electric motors or gears encased in the bridge. As in the bridging platform this turning bridge is constructed of metal and does not extend to the bottom of the bath, so it has the same disadvantages as the bridging platform. In addition, in both of the known arrangements the guide rails are unprotected and thus constitute a danger spot for bathers because of their slipperiness, and the squeeze areas before the rolling jackwheels cannot be protected against interference. Moreover such a floating member can only be moved when the bath is actually full of water, since otherwise the buoyancy cannot be utilised.

Finally stationary bath dividers are known (cf. German Offenlegungsschrift No. 2 118 991, issued on Oct. 26, 1972) which, however, are also mere floating bodies and can be raised from a submerged position by using buoyancy of water. Since these floating concrete bodies do not in every case reach from the surface of the water or the edge of the bath to the bottom of the bath, and in order to reduce the height of the construction - which would naturally also reduce the construction costs for deepening of the bottom of the pool, security aprons can be arranged to avoid underswimming. These bath-dividing floating bodies are not movable along the length of the bath and are not very stable since without substantial additions to the walls of the bath they cannot be secured against tilting. Also in the known arrangement for dividing a 50 m bath into two 25 m baths two floating bodies are necessary in each case.

3. Object of Invention

The main object of the invention is to improve the known swimming baths so that variable division of the bath is possible, the bath dividers can be economically manufactured, and use is sure and safe without restricting or in any way limiting the free access to the bath.

SUMMARY OF THE INVENTION

According to the invention this object is achieved by constructing the bath divider as a concrete or reinforced concrete wall extending from the upper edge of the swimming bath to the bottom thereof with the bath surround being freely accessible.

The advantages thus obtained particularly reside in that the bath divider can be cheaply prefabricated or may be produced at the place where it is to be used, that it is impossible to swim under it and that there is no danger of injury caused by the lower edge of the bath divider when it is moved, while in contrast to the known arrangement no guides or rails or the like which could hinder free access are openly arranged on the bath surround, thus also reducing the danger of accidents.

In case of deck-level system swimming pools with overflow channels essentially in the plane of the surround of the bath the dangers caused by the guide rails or jackwheels can preferably be removed by an arrangement wherein the guide rails for the jack wheels of the bath divider are arranged in the overflow channels, the jack wheels are mounted on the bath divider by means of brackets and the brackets or the jack wheels supported thereby are each synchronously driven by means of a continuous conveyor arranged in the overflow channels. By mounting lifting members on each bracket for automatic raising and lowering of the grating of the respective overflow channel the grating over the overflow channels can be removed and replaced extremely simply and therefore be used for concealed placement of the necessary guides.

In order to adapt the bath divider according to the present invention to said deck-level system baths, which have become quite common and widely used in the past years both longitudinal upper edges of the bath divider may preferably be provided with outwardly sloping bevellings, the angle of inclination and the width of which correspond to those of the bevellings of the partitions of the deck-level overflow channels. Thus the energy of the waves caused by normal bathing, i.e. by the movement of the bathers, will easily be absorbed when hitting the side walls of the bath divider without being reflected, or even pass over the top of the latter. Particularly in the case when the bath is used for swimming contests constant conditions are guaranteed at both ends the bath divider then being used as one end wall of the lanes the other being one of the fixed front walls.

In yet another advantageous embodiment according to the invention the conveyors are connected to each other at one end by means for synchronous driving. This makes movement of the bath divider particularly safe.

In a further preferred construction according to the invention the bath divider is provided with a space which is open at the bottom, extends in the direction of the lenght of the bath and is divided by one or several partition walls. This not only provides for a simple and cheap production of the bath divider, but the latter can also be constructed so as to be particularly rigid, which contributes to safety when it is being manipulated and when it is being used as a dividing board.

In order to keep the support and driving forces low while by comparison with known swimming bodies the mounting is provided stable enough for use as a starting ramp and operation is safe according to another embodiment of the invention the bath divider may preferably be constructed as a buoyant member provided with spaces filled with air or gas.

DESCRIPTION OF THE DRAWINGS

Other and further objects of the present invention will be apparent from the following description and claims and are illustrated in the accompanying drawings which by way of illustration show preferred embodiments of the present invention and the principles thereof and what now are considered to be the best modes contemplated for applying these principles. Other embodiments of the invention embodying the same or equivalent principles may be used and structural changes may be made as desired by those skilled in the art without departing from the present invention and the scope of the appended claims. In the drawings show:

DESCRIPTION OF THE PREFERRED EMBODIMENT

Figure 1:
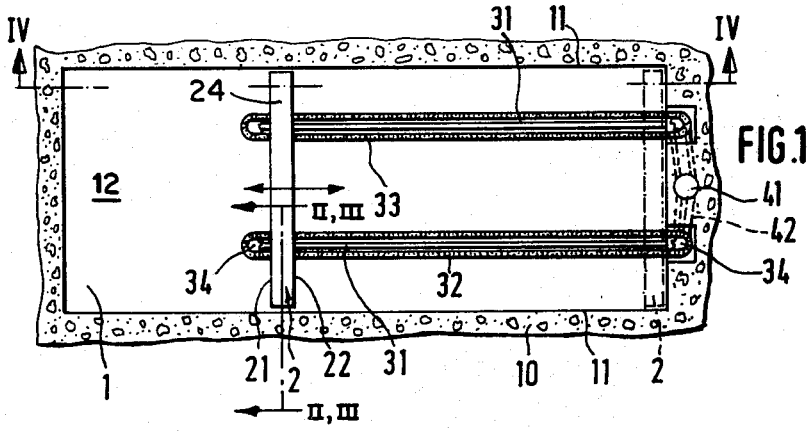
FIG. 1 the plan view of a swimming bath equipped with a bath divider according to the invention, FIG. 2 a partial cross section, taken on a larger scale through the swimming bath on line II—II of FIG. 1 in the region of the bath divider, FIG. 3 a partial section on line III—III of FIG. 1, of a variation of the FIG. 2 embodiment on yet another scale of a bath divider with support in the overflow channels, and FIG. 4 a longitudinal section on line IV/IV of FIG. 1 but on a larger scale through a swimming bath according to either FIG. 2 or FIG. 3 to adapt it to a deck-level system bath.

In a rectangular swimming bath or pool 1 having a surround 10, guide rails 31 are positioned parallel to and at a distance from side walls 11 and on the bottom 12 of the bath. A bath divider 2 extending from one side wall 11 to the other is made from concrete or reinforced concrete, has an inverted U-shaped cross-section and is formed by two vertical end walls 20 and two vertical side walls 21, 22 joined by a horizontal surface 24. The space 25 enclosed by the two end walls 20, the two side walls 21, 22 and the horizontal surface 24 is filled with a gas, e.g. air, and divided by partition walls 23. The lower ends of these walls are provided with supports for track rollers 27, which run on the guide rails 31 and thus carry and guide the bath divider 2. Beside each guide rail 31 an endless conveyor 32, 33 made of a rust-resistant material is arranged which is turned at each end round a roller 34, e.g. an idler roller, and is tensionally or form-lockingly connected to a part of the bath divider 2 in a suitable manner, e.g. by means of a plate 36. The two rollers 34 located at the end of the swimming bath 1 are connected with each other via a driving chain 42 driven by a motor 41. In order to divide the swimming bath 1 into two baths of a particular size, the motor 41 is set in operation so that the bath divider 2 can be moved into any desired position over the guide rails 31. When it is not in use it can be put in the position shown with a chain-dotted line in FIG. 1.

By the mechanical coupling of the drive system an absolutely even movement of the bath divider 2 is achieved without any danger of tilting or twisting inside the bath, i.e. the bath divider 2 is always at right angles to the side walls 11. To control the process an electronic system is preferably provided making it possible to have the greatest possible automatic control of the movement after choosing the desired position.

The arrangement of the plates 36 and the conveyors 32, 33 as double chains ensures that the chains pull the bath divider 2 in every case and that when changing the direction of pull by moving the points of application from one run to the other of a pair of chains it is possible to alter the application of power without difficulty.

Figure 2:
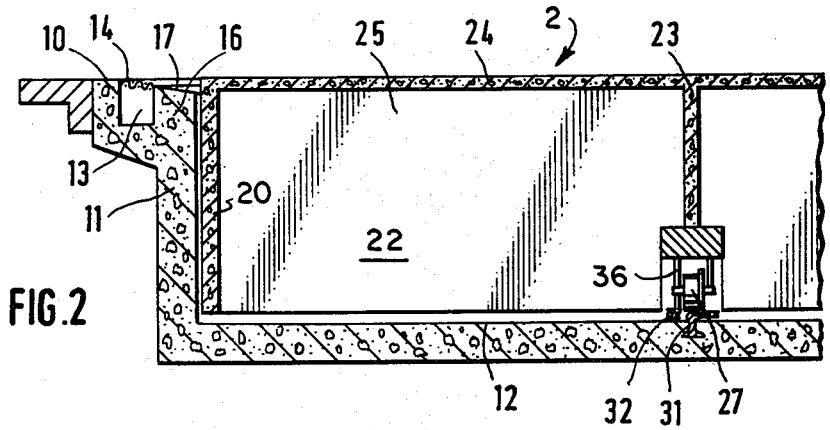
Figure 3:
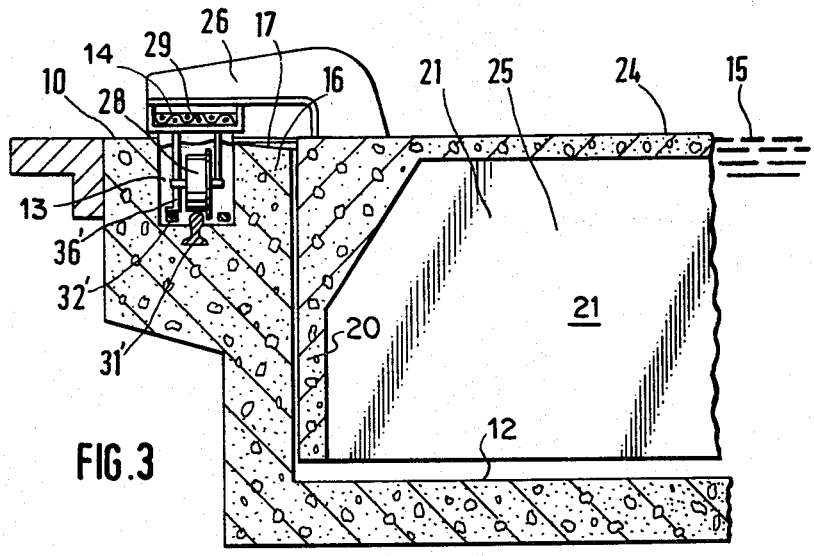

One possibility of leaving the swimming bath 1 free of guide rails and conveyor means is illustrated in FIG. 3, wherein like numerals denote like parts already described with respect to FIGS. 1 and 2. The guide rails 31 are arranged at the bottom of overflow channel 13 in the edge of the surround 10 of the side walls 11. The bath divider 2 has a bracket 26 on each end which on its free end has in a rotatably mounted manner one or more jack wheels 28, these wheels running on and bearing against the guide rails 31'. As in the arrangement according to FIGS. 1 and 2 continuous or endless conveyors 32' can be arranged beside the guide rails 31' (only one of the overflow channels with its guide rail and conveyor is shown, with it being understood that the other would be a mirror image) connected by carrier plates 36' for form-locking or tensional connection to the brackets 26 of the bath divider 2 and provided with suitable drive means.

This embodiment is very suitable for baths with a height adjustable floor and favourably used e.g. in deck-level baths with modern overflow channels, which are covered with jointed gratings 14. In order to make it possible to move the bath divider 2 without completely removing the grating 14 a removal or lifting device which is not illustrated in detail here is provided to raise the grating 14, whereupon the latter slides through a hollow member 29, which is carried by the bracket 26, too, and is located above the jack wheel 28, and then reaches its resting position above the overflow channel 13.

Figure 4:
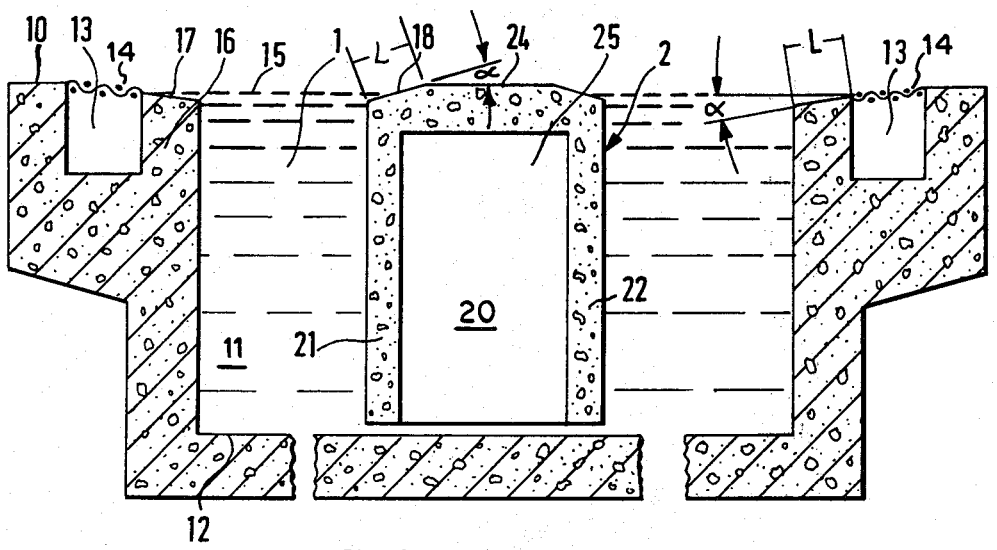

In such deck-level baths the overflow channels 13 lie essentially in the plane of the surround 10 of the bath 1 and are separated from it by means of partitions 16. These partitions 16 lie a little lower than the periphery or surround 10 of the bath and in contrast to the horizontal surround 10 they have bevellings 17 inclined towards the bath 1. As shown in FIG. 4, similar bevellings 18 are provided along the longitudinal edges of the horizontal surface 24 of the bath divider 2, i.e. their angle of inclination $\alpha$ and their length L correspond essentially to those of the bevellings 17 on the fixed side and front walls of the swimming bath. Advantageously they are selected so as to achieve optimum refraction conditions.

The horizontal surface 24 has at least the same level as the highest edge of the overflow partitions 16 although preferably it should have the same level as the surround 10. In case of a filled swimming bath 1 the water level 15 will reach the top edge of the partitions 16 leaving free of water the surround 10 and the horizontal surface 24. Waves resulting from normal bathing will hit the bevellings 17 and 18 and may pass into the overflow channels 13 or over the surface 24 without being reflected. Thus undisturbed bathing and swimming is possible as well as there are attained absolutely equal wave reflection and refraction conditions along all walls concerned.

Naturally the bath divider can have the shape of a continuous concrete plate instead of the illustrated hollow shape, the thickness of the plate being derived from and corresponding to the static requirements.

The length of the swimming bath 1 results from the desired length of the lanes, e.g. 50 m including the thickness of the bath divider and possibly the space to accomodate functional elements, e.g. the rollers 34.

For various reasons, e.g. constructional or economic, the guiding of the bath divider will normally take place over only part of the length of the swimming bath. However, it is also possible to provide guide rails along its entire length. In each case the guides should extend over more than half the length so that two part-baths of equal size can be obtained, e.g. two 25 m baths in a 50 m bath.

What is claimed is:

1. A swimming pool and pool divider in combination, comprising: a generally rectangular swimming pool having opposed parallel and vertically extending side walls, opposed parallel and vertically extending end walls, a bottom wall, an open top area for swimming defined by the upper portions of said side and end walls; a pair of upwardly facing parallel rails extending parallel to said side walls from one end wall of said swimming pool toward the other end wall; a concrete divider wall extending vertically completely from one side wall to the opposite side wall and for essentially the complete height of the swimming pool from the bottom wall for the full height of said side walls; roller means rotatably mounted on said concrete divider wall for rotation about a horizontal axis perpendicular to said side walls with said roller means in direct engagement with each of said rails, for supporting the weight of said concrete divider wall and permitting movement of said concrete divider wall from a position immediately adjacent said one end wall to a position intermediate said end walls to divide said swimming pool into two swimming areas; an upwardly opening overflow channel parallel to and outwardly spaced from each of said side walls so as to receive water from the swimming pool splashed over the upper portions of said side walls into said overflow channel, and each of said overflow channels having a bottom wall spaced outwardly from and below the adjacent upper portion of the side wall; said rails being respectively mounted on said bottom walls of said overflow channels; and power means drivingly connected between said swimming pool and said divider wall for driving said concrete divider wall along said rails and for maintaining the parallel position of said concrete divider wall with said end walls.

2. The apparatus of claim 1, wherein said concrete divider wall has an upwardly facing surface provided with parallel oppositely bevelled surfaces that slant downwardly toward their respective side edges toward the water within the swimming pool, and wherein said swimming pool includes an upwardly facing top surface of said side walls between the swimming area of said swimming pool and said overflow channels, which upwardly facing top surfaces are bevelled downwardly and inwardly at substantially the same angle and width as said bevelled surfaces of said concrete divider wall.

3. The apparatus of claim 1, wherein said concrete divider wall comprises opposed concrete first and second vertical walls that are parallel to each other and parallel to said end walls, concrete end walls completely extending between said first and second walls closely adjacent said swimming pool side walls, and a top concrete wall completely extending between said first and second walls and said divider end walls to thereby form a hollow interior chamber; and said concrete divider wall further including at least one bracing wall within said chamber rigidly extending between said first and second walls.

4. The apparatus of claim 3, wherein said concrete divider wall sufficiently seals said chamber so that the chamber is substantially completely filled with gas when said swimming pool is filled with water.

5. The apparatus of claim 4, wherein said concrete divider wall is provided with aperatures providing free fluid communication between said chamber and said swimming pool only in the vicinity of the bottom edges of said first and second walls and said end walls.

6. The apparatus of claim 1, wherein said roller means include brackets rigidly secured to the opposite upper side portions of said concrete divider wall and extend cantilever outwardly from said concrete divider wall above said side walls, and a roller mounted on the uppermost portion of each of said brackets for rotation about a horizontal axis and in direct engagement with said rails, respectively; said power means comprises two endless conveyors respectively adjacent said rails within said overflow channels, and having a portion of each of said endless conveyors being driveingly secured to said concrete divider wall through said brackets, and means for synchronously driving said conveyors within said overflow channels in a first direction to move said concrete divider wall towards said one end wall and selectively in the reverse direction to move said concrete divider wall away from said one end wall.

7. The apparatus of claim 6, wherein said swimming pool includes a single flexible elongated grating covering substantially the entire open top of each of said overflow channels, and means for lifting each of the gratings away from its respective overflow channel on each side of said swimming pool only immediately adjacent said brackets to provide for passage of said roller means including guide means on said brackets having an upwardly facing guide surface directly engaging its grating to permit passage of said roller means and at least a portion of said bracket beneath said grating, and automatically lifting and dropping said grating before and after its bracket during movement of said concrete divider wall.

* * * * *